US010001144B2

(12) United States Patent
Shen et al.

(10) Patent No.: US 10,001,144 B2
(45) Date of Patent: Jun. 19, 2018

(54) BLOWER

(71) Applicant: Johnson Electric S.A., Murten (CH)

(72) Inventors: Jun Feng Shen, Shenzhen (CN); Ching Hang Leung, Hong Kong (CN); Siu Chun Tam, Hong Kong (CN)

(73) Assignee: JOHNSON ELECTRIC S.A., Murten (CH)

( * ) Notice: Subject to any disclaimer, the term of this patent is extended or adjusted under 35 U.S.C. 154(b) by 179 days.

(21) Appl. No.: 14/604,236

(22) Filed: Jan. 23, 2015

(65) Prior Publication Data

US 2015/0204352 A1 Jul. 23, 2015

(30) Foreign Application Priority Data

Jan. 23, 2014 (CN) ..... 2014 1 0032585

(51) Int. Cl.

| | |
|---|---|
| ***F04D 29/42*** | (2006.01) |
| ***F04D 29/62*** | (2006.01) |
| ***F04D 17/10*** | (2006.01) |
| ***A47K 10/48*** | (2006.01) |
| ***F04D 29/28*** | (2006.01) |

(52) U.S. Cl.

CPC ..... *F04D 29/624* (2013.01); *A47K 10/48* (2013.01); *F04D 17/10* (2013.01); *F04D 29/285* (2013.01); *F04D 29/42* (2013.01)

(58) Field of Classification Search

CPC .. F04D 29/281; F04D 29/2222; F04D 29/626; F04D 29/624; F04D 29/285; F04D 17/10; A47K 10/48

USPC ..... 415/98, 206, 186 R; 29/889.4

See application file for complete search history.

(56) References Cited

U.S. PATENT DOCUMENTS 509,321 A * 11/1893 Marsden ..... B64C 11/24 415/227
3,144,204 A * 8/1964 Bohanon ..... F04D 29/282 29/513

(Continued)

FOREIGN PATENT DOCUMENTS

CN 102454631 5/2012
DE 2622018 A1 * 12/1977 ..... F04D 29/162

(Continued)

OTHER PUBLICATIONS

English Translation of DE2622018 dated Dec. 8, 1977.*

*Primary Examiner* — Nathan Zollinger
(74) *Attorney, Agent, or Firm* — Muncy, Geissler, Olds & Lowe, P.C.

(57) ABSTRACT

A blower has a centrifugal impeller driven by an electric motor. The centrifugal impeller has a base plate, a cover plate defining an air inlet, a plurality of blades mounted between the base plate and the cover plate, and a reinforcement ring mounted to the cover plate around the air inlet. The cover plate includes an outwardly extending flange at the air inlet. The reinforcement ring has a flange fitted around the flange of the cover plate. Each blade has cover plate mounting portions and base plate mounting portions. The cover plate has blade mounting holes engaged with the cover plate mounting portions. The base plate has blade mounting holes engaged with the base plate mounting portions. The reinforcement ring increases the strength of the cover plate, to avoid breakage under high speed rotation.

7 Claims, 5 Drawing Sheets

(56) References Cited

U.S. PATENT DOCUMENTS

| | | | | | |
|---|---|---|---|---|---|
| 3,225,422 | A * | 12/1965 | Sebok | B21D 53/267 | 29/463 |
| 3,507,581 | A * | 4/1970 | Jensen | F04D 29/2222 | 29/889.4 |
| 4,428,717 | A * | 1/1984 | Catterfeld | F04D 7/04 | 29/889.4 |
| 4,720,242 | A * | 1/1988 | Lovisetto | F04D 29/2222 | 415/140 |
| 5,810,557 | A * | 9/1998 | Akinkuotu | F04D 29/281 | 415/206 |
| 6,033,183 | A * | 3/2000 | Genster | B29C 45/0062 | 416/183 |
| 8,056,686 | B2 * | 11/2011 | Jameson | F16H 41/28 | 192/212 |
| 2016/0290344 | A1 * | 10/2016 | Lewis | F04D 29/023 | |

FOREIGN PATENT DOCUMENTS

| | | | | |
|---|---|---|---|---|
| EP | 0537967 | A1 * | 4/1992 | F16B 19/1054 |
| GB | 849744 | A * | 9/1960 | F04D 17/165 |

* cited by examiner

BLOWER

CROSS REFERENCE TO RELATED APPLICATIONS

This non-provisional patent application claims priority under 35 U.S.C. § 119(a) from Patent Application No. 201410032585.5 filed in The People's Republic of China on Jan. 23, 2014, the entire contents of which are hereby incorporated by reference.

FIELD OF THE INVENTION

This invention relates to a blower and in particular, to a centrifugal impeller of the blower. It also relates to electrical appliances, such as a vacuum cleaner or a hand drier, that use the blower.

BACKGROUND OF THE INVENTION

As a main component of a hand drier, a blower comprises a centrifugal impeller and a motor for driving the impeller. The impeller moves air to form a pressurized airflow that is discharged via an air outlet. Hand driers and vacuum cleaners typically employ a centrifugal blower with a central air inlet and a peripheral air outlet.

Referring to FIG. 1, a conventional centrifugal impeller has a base plate 10, a cover plate 20, and a blade assembly 30 arranged between the base plate 10 and the cover plate 20. A motor shaft mounting hole 101 is formed at a central position of the base plate 10. An air inlet 201 is formed at a central position of the cover plate 20. The blade assembly 30 includes a plurality of curved blades 301 arranged annularly. Cover plate mounting portion 302 and base plate mounting portion (not shown) extent outwardly from a top side (close to the cover plate) and a bottom side (close to the base plate) of each curved blade 301, respectively. The cover plate 10 and the base plate 20 have rectangular blade mounting holes 202 and blade mounting holes (not shown) corresponding to the cover plate mounting portions 302 and base plate mounting portions (not shown), respectively.

One drawback of the conventional blower is that, when the motor speed is high, especially higher, than 33000 RPM, it is known for the centrifugal impeller to break. Basically, cracks occur in the cover plate, spreading out from the blade mounting holes 202 close to the air inlet 201. The cracks lead to the failure of the centrifugal impeller, reducing the lifespan of the blower.

SUMMARY OF THE INVENTION

Thus there is a desire for a blower with a prolonged lifespan.

Accordingly, in one aspect, the present invention provides a blower comprising: a centrifugal impeller, and an electric motor driving the impeller, wherein the centrifugal impeller comprises: a base plate; a cover plate defining an air inlet; a blade assembly mounted between the base plate and the cover plate, the blade assembly comprising a plurality of curved blades arranged around the air inlet; and a reinforcement ring mounted to the cover plate around the air inlet.

Preferably, the cover plate includes an outwardly extending flange at the air inlet, and the reinforcement ring also includes a flange that is closely fitted around the flange of the cover plate.

Preferably, each blade has a first side close to the cover plate and a second side close to the base plate, cover plate mounting portions project from the first side, base plate mounting portions project from the second side, the cover plate has blade mounting holes engaged with the cover plate mounting portions, and the base plate has blade mounting holes engaged with the base plate mounting portions.

Preferably, the reinforcement ring has mounting holes engaged with some of the cover plate mounting portions to fix the reinforcement ring to the cover plate.

Preferably, the blade mounting holes of the base plate and/or cover plate are rectangular in shape.

Preferably, the cover plate mounting portions comprise a plurality of mounting protrusions that have a rectangular shape with a recess formed in an outer side of the rectangle.

Preferably, the cover plate mounting portions of each blade includes at least four mounting protrusions, among the at least four mounting protrusions, at least one mounting protrusion close to the air inlet is fixedly connected to the cover plate and the reinforcement ring.

Preferably, the reinforcement ring includes an annular bottom plate and a flange extending around an inner hole of the annular bottom plate, the annular bottom plate lies on the cover plate and has mounting holes through which the cover plate mounting portions pass.

Preferably, a ratio of an outer diameter of the reinforcement ring to an outer diameter of the cover plate or base plate is 0.48 to 0.61.

According to a second aspect, the present invention provides an electrical appliance comprising an outer housing with an inlet opening and an outlet opening, and the blower described above, mounted within the outer housing.

Preferably, the appliance is a hand drier or a vacuum cleaner.

In embodiments of the present invention, a reinforcement ring is mounted at the position of the air inlet, which increases the strength of the cover plate, effectively avoids the break of the centrifugal impeller due to high speed rotation of the motor, and greatly prolongs the lifespan of the impeller, blower and home appliance such as the vacuum cleaner and hand drier.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
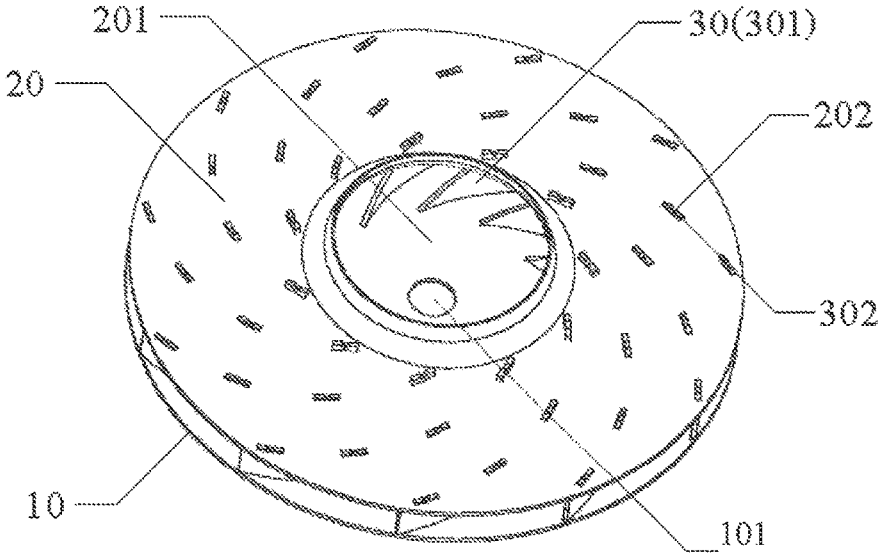
FIG. 1 (Prior Art)
FIG. 1 is a perspective view of a conventional centrifugal impeller.
Figure 2:
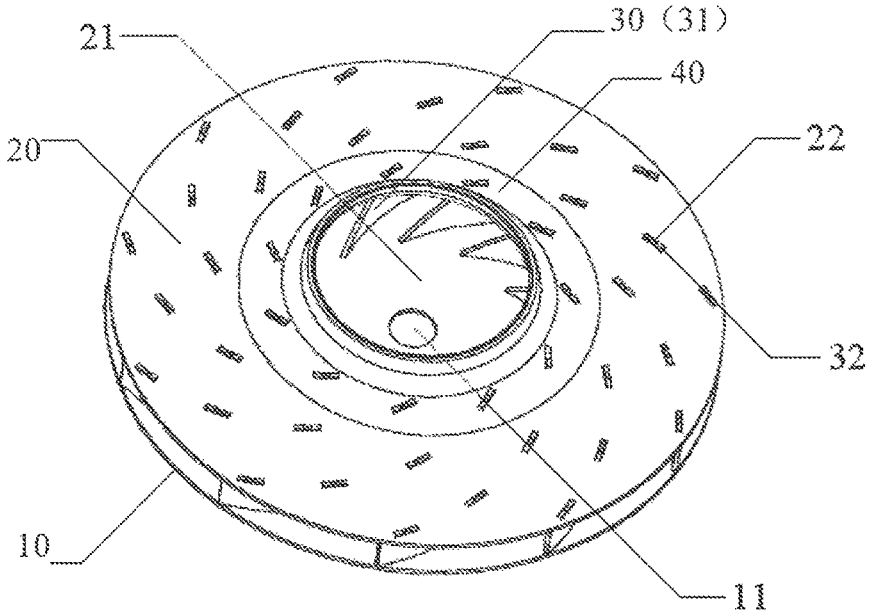
FIG. 2 is a perspective view of a centrifugal impeller according to the preferred embodiment of the present invention.
Figure 3:
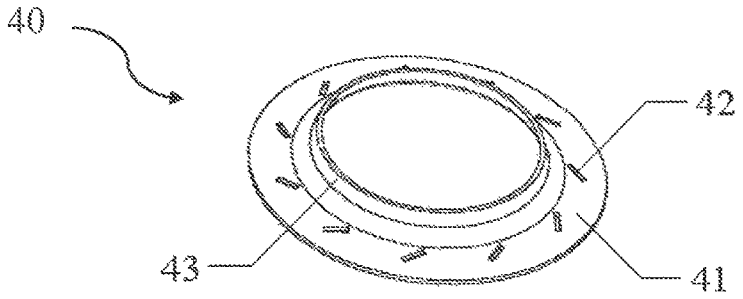
FIG. 3 is a perspective view of a reinforcement ring of the centrifugal impeller of FIG. 2.
Figure 4:
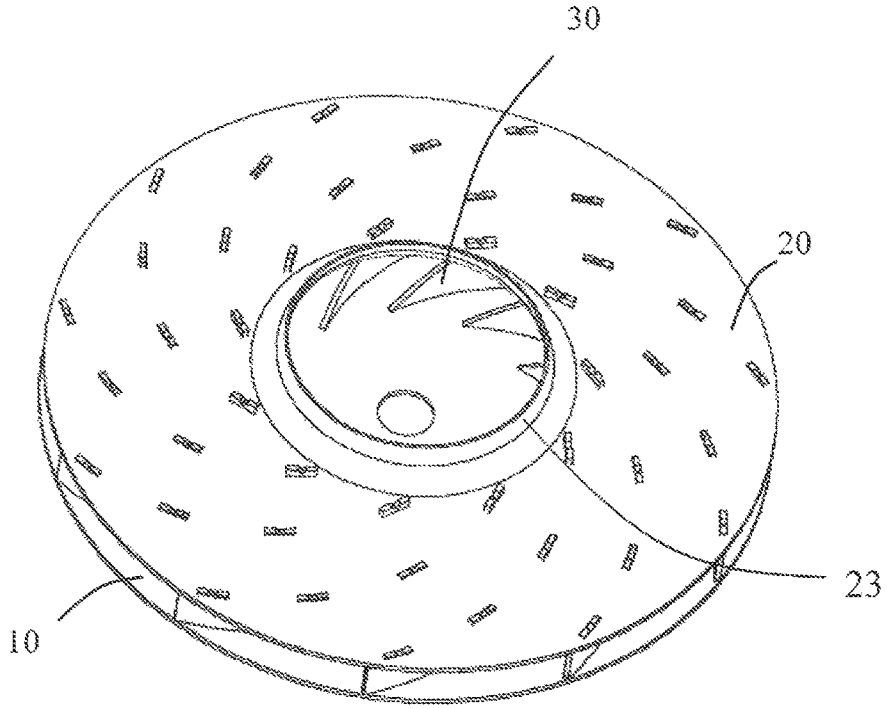
FIG. 4 is a perspective view of the centrifugal impeller of FIG. 2, with the reinforcement ring removed.
Figure 5:
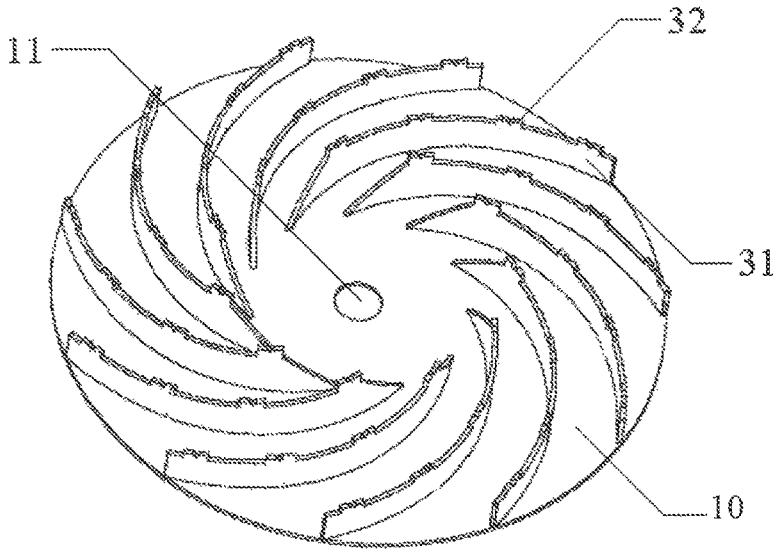
FIG. 5 is a perspective view of a base plate and a blade assembly of the impeller of FIG. 2.
Figure 6:
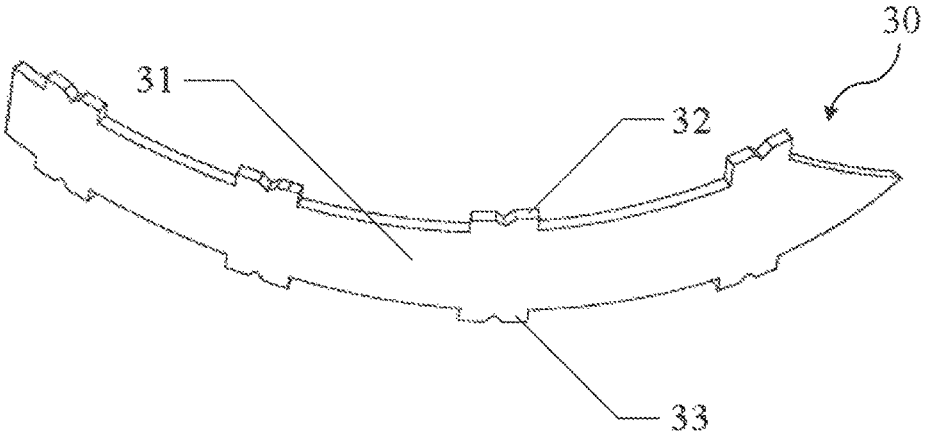
FIG. 6 illustrates a blade of the impeller of FIG. 2.

A centrifugal impeller in accordance with one embodiment of the present invention is described below with reference to FIGS. 2 to 6.

The centrifugal impeller has a base plate 10, a cover plate 20 defining an air inlet 21 at a central position of the cover plate 20, a blade assembly 30 arranged between the base plate 10 and the cover plate 20, and a reinforcement ring 40 mounted to the cover plate 20 around the air inlet 21.

Preferably, the base plate 10, the cover plate 20, the blade assembly 30, and the reinforcement ring 40 are all fabricated from a metal material and ideally from an aluminum material.

The base plate 10 defines a connecting hole 11 at a central position of the base plate 10 corresponding to the air inlet 21 of the cover plate 20, to allow a motor shaft to pass there through.

In the present embodiment, the blade assembly 30 includes a plurality of curved blades 31 arranged annularly. A plurality of cover plate mounting portions 32 and a plurality of base plate mounting portions 33 (FIG. 6) project outwardly from a top side (close to the cover plate) and a bottom side (close to the base plate) of each curved blade 31. The cover plate 20 has blade mounting holes 22 for engaging with the cover plate mounting portions 32, and the base plate 10 also has blade mounting holes (not shown) for engaging with the base plate mounting portions. Preferably, rivet connections are used to mount the cover plate mounting portions 32 and base plate mounting portions 33 of the blades 31 to the blade mounting holes of the cover plate 20 and the base plate 10. Specifically, the mounting portions 32, 33, are deformed after being inserted through the corresponding mounting holes to lock the cover plate and base plate to the blades.

In the present embodiment, the reinforcement ring 40 has an annular bottom plate 41 in which mounting holes 42 are formed. A flange 43 projects upwardly from an inner edge of the annular bottom plate 41. The flange 43 has a shape matching with the shape of the air inlet 21 of the cover plate 10. The annular bottom plate 41 lies on an outer surface of the cover plate 20, and the flange 43 is a close fit around a flange 23 (FIG. 4) of the cover 20 at the air inlet. The mounting holes 42 have the same shape as the blade mounting holes 22 close to the air inlet 21 and are aligned with the blade mounting holes 22, so that the cover plate mounting portions 32 of the blades 31 can sequentially pass through the blade mounting holes 22 of the cover plate and the mounting holes 42 of the reinforcement ring and be mounted thereto.

Preferably, the outer edge of the cover plate 20 or base plate 10 is aligned with outer ends of the blades 31, i.e. the cover plate, base plate and the blades have the same outer diameter. The ratio of the outer diameter of the reinforcement ring 40 to the outer diameter of the cover plate/base plate is from 0.48 to 0.61. This configuration makes it possible to increase the strength of the cover plate 22 without adding too much weight to the impeller.

Preferably, the blade mounting holes 22 are rectangular in shape. The cover plate mounting portions 32 include a plurality of mounting protrusions. The mounting protrusion are also rectangular in shape, with a recess formed at an upper side of the rectangle so that, in the riveting process, the portions on opposite sides of the recess of the mounting protrusion can be deformed so that they press and hold the cover plate 20/reinforcement ring 40 around the blade mounting holes 22/42 from an outside of the cover plate 20/an outside of the reinforcement ring 40, thus preventing the cover plate 20, reinforcement ring 40 and the blades 31 from becoming disengaged. Similarly, the blade mounting holes of the base plate 10 are rectangular in shape, the base plate mounting portions are also rectangular in shape, with a cutout formed at an upper side of the rectangle, and the rivet joints between the base plate mounting portions of the blades 31 and the base plate 10 are the same as that between the cover plate mounting portions of the blades 31 and the cover plate 20.

Preferably, the number of the blade mounting holes 22 corresponding to each curved blade 31 is four. It is to be understood that the number of the blade mounting holes 22 corresponding to each curved blade 31 may be more or less than four. Correspondingly, the mounting holes on the base plate for engaging with each blade 31 may be less than, equal to or greater than four.

Preferably, the cover plate mounting portions 32 of each blade 31 have at least four mounting protrusions. Among the at least four mounting protrusions, at least one mounting protrusion close to the air inlet is fixedly mounted to the cover plate 20 and the reinforcement ring 40.

In comparison with the conventional impeller, a reinforcement ring is mounted at the position of the air inlet, which effectively avoids breakage of the centrifugal impeller due to high speed rotation of the motor, and greatly prolongs the lifespan of the blower.

Figure 7:
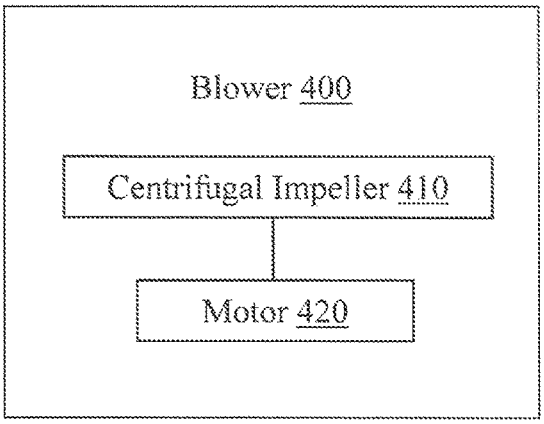
FIG. 7 is a schematic representation of a blower for use in an electrical appliance, such as a hand drier or vacuum cleaner.

FIG. 7 is a schematic representation of a blower 400 according to an embodiment of the present invention, which is suitable for an electrical appliance such as a hand drier or a vacuum cleaner. The blower includes a centrifugal impeller 410 as described above and an electric motor 420 for driving the impeller 410. The blower is mounted within an outer housing of the appliance. The outer housing has an inlet opening and an outlet opening. As the blower operates, the impeller 410 rotates to establish an air flow.

Figure 8:
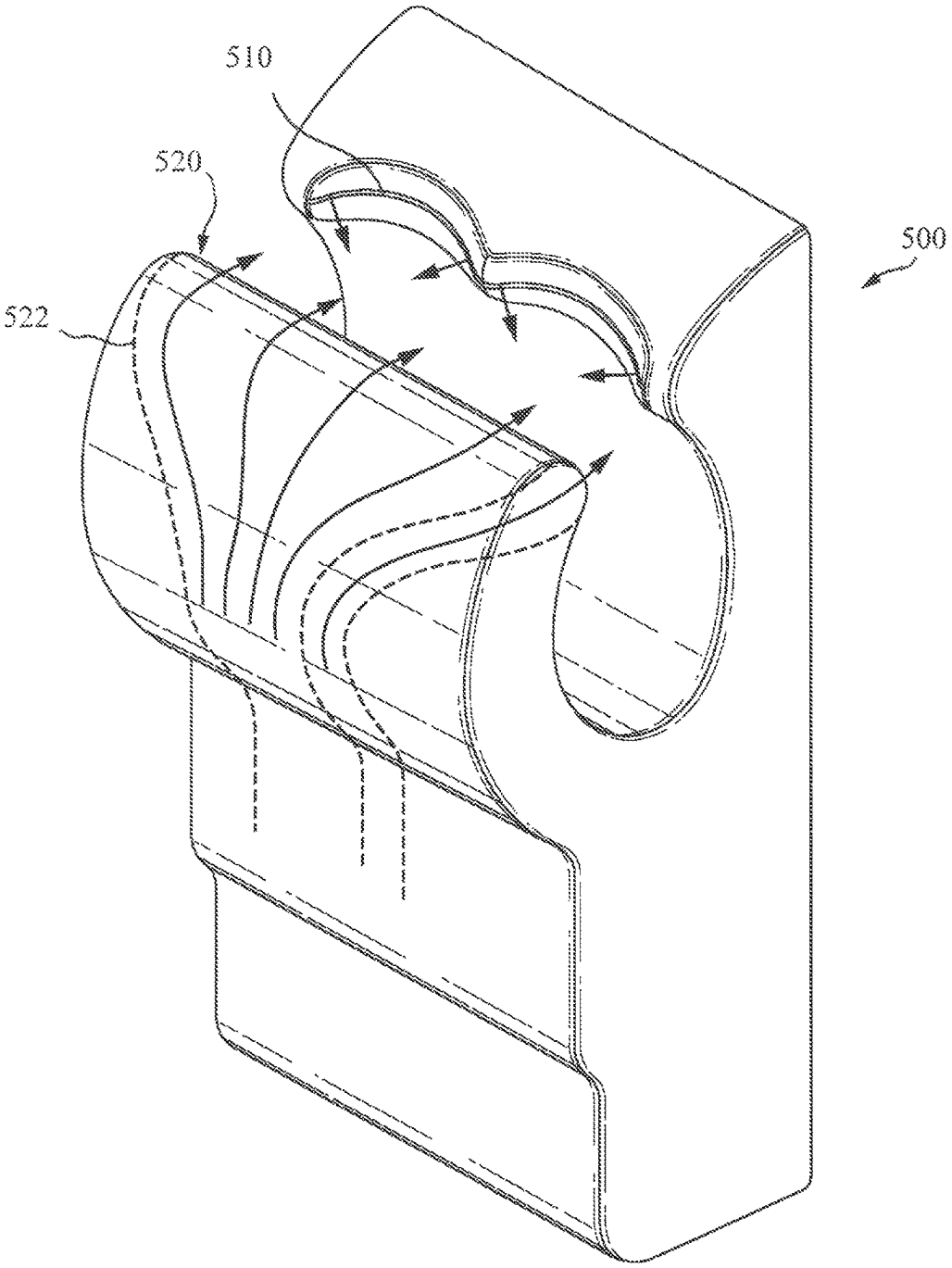
FIG. 8 illustrates a hand drier according to second embodiment of the present invention.

Referring to FIG. 8, the housing of a hand drier 500 according to one embodiment of the present invention has an inlet opening (not shown) and outlet openings 510, 520. The blower (not shown) is mounted within the outer housing. Under the driving of the motor, the centrifugal impeller establishes high speed airflows 522 which are discharged via their corresponding outlet openings.

Figure 9:
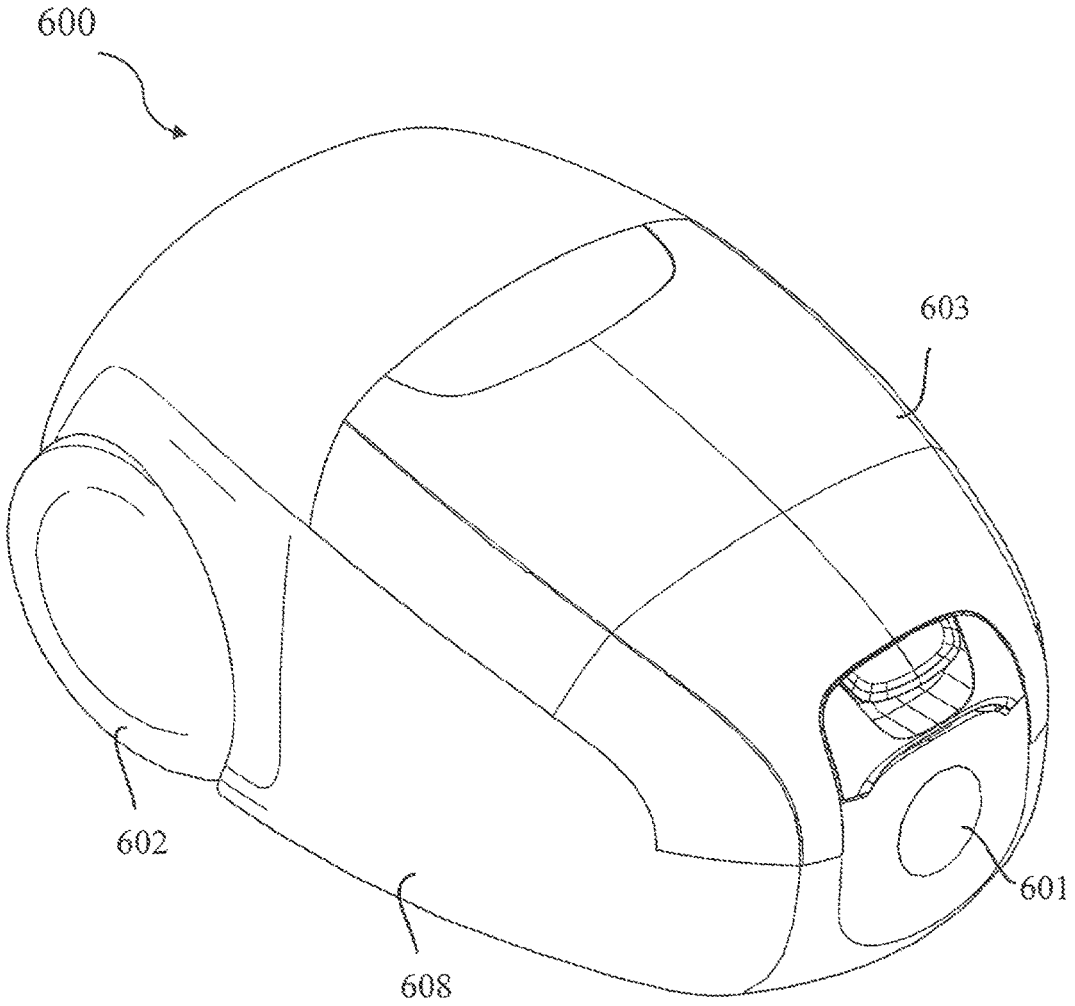
FIG. 9 illustrates a vacuum cleaner according to another embodiment of the present invention.

Referring to FIG. 9, the housing of a vacuum cleaner 600 according to one embodiment of the present invention includes a main body 608, a top cover 603 mounted to the main body 608, and wheels 602 mounted to a bottom side of the main body 608. The main body 608 has an inlet opening 601. The blower is mounted within a chamber defined by the main body 608 and the top cover 603. Under the driving of the motor, the centrifugal impeller rotates to establish a low pressure region, i.e. a vacuum, such that outside dust and debris are drawn into the vacuum cleaner via the inlet opening 601.

It is to be understood that the centrifugal impeller and centrifugal blower provided by the present invention may also be used in other types of electrical appliances.

In the description and claims of the present application, each of the verbs "comprise", "include", "contain" and "have", and variations thereof, are used in an inclusive sense, to specify the presence of the stated item or feature but do not preclude the presence of additional items or features.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of example only, and various other modifications will be apparent to persons skilled in the field without departing from the scope of the invention as defined by the appended claims.

The invention claimed is:

1. A blower comprising:

a centrifugal impeller, and an electric motor driving the impeller, wherein the centrifugal impeller comprises:

a base plate;

a cover plate defining an air inlet;

a blade assembly mounted between the base plate and the cover plate, the blade assembly comprising a plurality of curved blades arranged around the air inlet; and a reinforcement ring mounted to an outer surface of the cover plate with a close fit around the air inlet to strengthen the centrifugal impeller against breakage, wherein the cover plate includes an outwardly extending flange at the air inlet, and the reinforcement ring also includes a flange that is closely fitted around the flange of the cover plate, the reinforcement ring includes an annular bottom plate and the flange of the reinforcement ring extends around an inner hole of the annular bottom plate, the annular bottom plate lies on the cover plate and has mounting holes through which cover plate mounting portions pass, the cover plate mounting portions comprise a plurality of mounting protrusions that have a rectangular shape with a recess formed in an outer side of the rectangular shape, wherein each blade has a first side close to the cover plate and a second side close to the base plate, the cover plate mounting portions project from the first side, base plate mounting portions project from the second side, the cover plate has blade mounting holes engaged with the cover plate mounting portions, and the base plate has blade mounting holes engaged with the base plate mounting portions.

2. The blower of claim 1, wherein the mounting holes are engaged with some of the cover plate mounting portions to fix the reinforcement ring to the cover plate.

3. The blower of claim 1, wherein the blade mounting holes of the base plate and/or cover plate are rectangular in shape.

4. The blower of claim 1, wherein the cover plate mounting portions of each blade includes at least four mounting protrusions, among the at least four mounting protrusions, at least one mounting protrusion close to the air inlet is fixedly connected to the cover plate and the reinforcement ring.

5. The blower of claim 1, wherein a ratio of an outer diameter of the reinforcement ring to an outer diameter of the cover plate or base plate is 0.48 to 0.61.

6. An electrical appliance comprising an outer housing with an inlet opening and an outlet opening, and the blower of claim 1 mounted within the outer housing.

7. The appliance of claim 6 wherein the appliance is a hand drier or a vacuum cleaner.

* * * * *